United States Patent [19]

Pappas

[11] Patent Number: 4,532,490

[45] Date of Patent: Jul. 30, 1985

[54] FAIL SAFE HIGH LIMIT CONTROL

[76] Inventor: Phillip M. Pappas, 12309 Hodges St., Houston, Tex. 77085

[21] Appl. No.: 497,004

[22] Filed: May 23, 1983

[51] Int. Cl.[3] ..... H01H 37/38; H01H 37/40

[52] U.S. Cl. ..... 337/320; 337/117; 200/83 B

[58] Field of Search ..... 337/320, 321, 322, 117, 337/118, 119, 327; 200/83 J, 83 B, 83 R

[56] References Cited

U.S. PATENT DOCUMENTS

| | | | |
|---|---|---|---|
| 2,688,064 | 8/1954 | Traver | 337/320 |
| 3,047,696 | 7/1962 | Heidorn | 337/320 |
| 3,585,328 | 6/1971 | Fiore | 337/320 |

*Primary Examiner*—Harold Broome

[57] ABSTRACT

Temperature limit control having a normally closed contact switch secured to a formed cup with vacuum operated formed diaphragm seal to cup bottom, contacts open on reduced vacuum as by boiling thermal fluid in the linear capillary tube welded to the cup below the diaphragm or boiling of fluid in a sensor bulb welded to the capillary tube end for remote temperature control, with vacuum leakage within lower cup, diaphragm, capillary tube and, or, sensor bulb releasing diaphragm from its pulled down position against inward formed dimples between the cup side and central outlet likewise opening contacts providing fail safe operation.

3 Claims, 8 Drawing Figures

FAIL SAFE HIGH LIMIT CONTROL

This invention is a high limit temperature control that may be employed as a linear control or as a remote control.

In the use of these types of controls over the past ten years or so where they have been employed in deep fat fryers as with my U.S. Pat. No. 3,075,702 I have noted that present available controls even though some are made vacuum operated fail safe type construction they leave much to be desired in their use and operation.

They are made with nickel plated copper capillary tube and sensor bulbs with soldered connections into the cup and into the bulb which tend to break or leak easily in use. Further, with extensive use the nickel plating on the copper sensor bulb and capillary tube come off and the bare copper in the cooking oil sets up a destructive electrolytic action with sometimes verdigris that is destructive to the cooking oil and foods being fried. Further, copper bulbs and capillaries have been found to become porous permitting fluid and vacuum to escape requiring replacement of the control.

These limitations and disadvantages have not in most instances caused fires, destruction, physical damage and possible loss of life however one serious flaw in this type of control that I have noted with its extensive use in deep fat fryers is that it is possible for the formed thin metal diaphragm to become bound or stationary in its pulled down position within the cup bottom to such a degree that the release or interruption of the vacuum does not restore it to its original formed position. In other words the snap action of its returning to its original formed position which causes the switch above to open its contacts fails to take place thus the fail safe vacuum operation is voided.

An object of my invention is to overcome this possibility and make the temperature limit control completely fail safe in its operation. To achieve this my disclosure provides inward formed dimples in the cup bottom about half way between the outer side of the cup and its central V outlet to which the V flared stainless steel capillary tube is welded. These dimples restrict the downward travel of the diaphragm when it is pulled by the vacuum introduced at the capillary tube or sensor bulb end. This prevents the diaphragm from canning or wedging itself in a fixed or stationary downward position that would prevent the breaking of the contacts on the reduction or interruption of the vacuum within the sealed system.

In addition to overcoming the serious disadvantages and limitations of contemporary high limit controls my invention is the first in the world to provide an all welded stainless steel hermetically sealed vacuum operated fail safe temperature limit control and as such offers other advantages and benefits not found with existing limit or temperature controls. The advantages include no plating to wear off, stainless steel does not become porous in use causing vacuum or fluid leakage, stainless steel is compatible with all foods and will not set up an electrolytic reaction, stainless steel is ideally suited to projection welding and such joints or seals are stronger, more enduring and leakproof than with soldered joints, with stainless steel the formed remote sensing bulb is much stronger yet is considerably thinner and lighter than copper making it more sensitive and accurate in sensing temeratures and conveying heat or cooling to the thermal fluid within the system for greater accuracy and control in both the cut off in opening the contacts and the automatic reset provided by restoration of the vacuum as the thermal fluid is cooled to a safe temperature and the switch contacts close by the snap action diaphragm.

All of the aforementioned facts and objects of the invention as well as the details of a typical and illustrated embodiment will be understood fully from the following description of the accompanying drawings:

Figure 1:
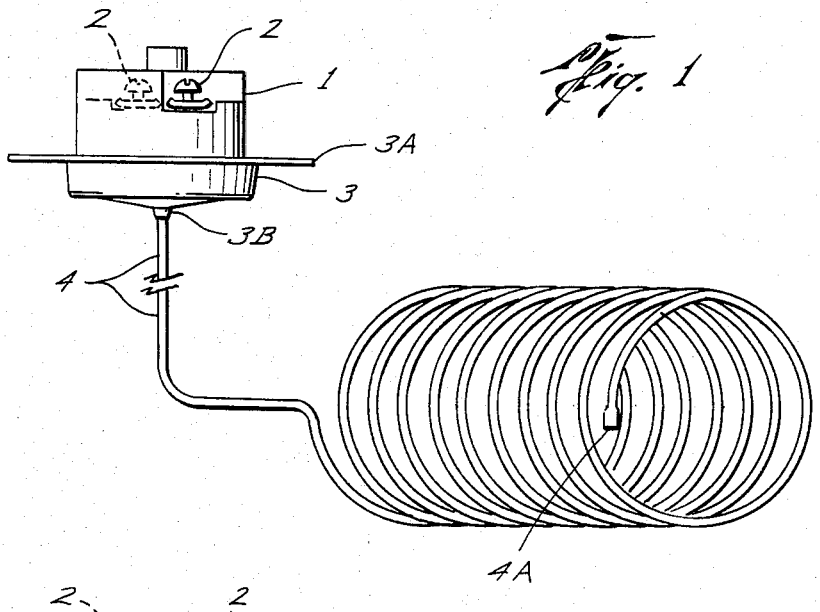
FIG. 1 is a side elevation view of the limit control with capillary tube as used for linear protection.

Referring to the drawings in detail:

FIG. 1 is a side elevation view of the limit control with switch housing 1 with terminal bolts 2 with switch mounted in and secured to stainless steel formed cup with mounting flange 3A with central V outlet 3B with stainless steel capillary tube 4 with capillary flattened and welded end closure 4A.

Figure 2:
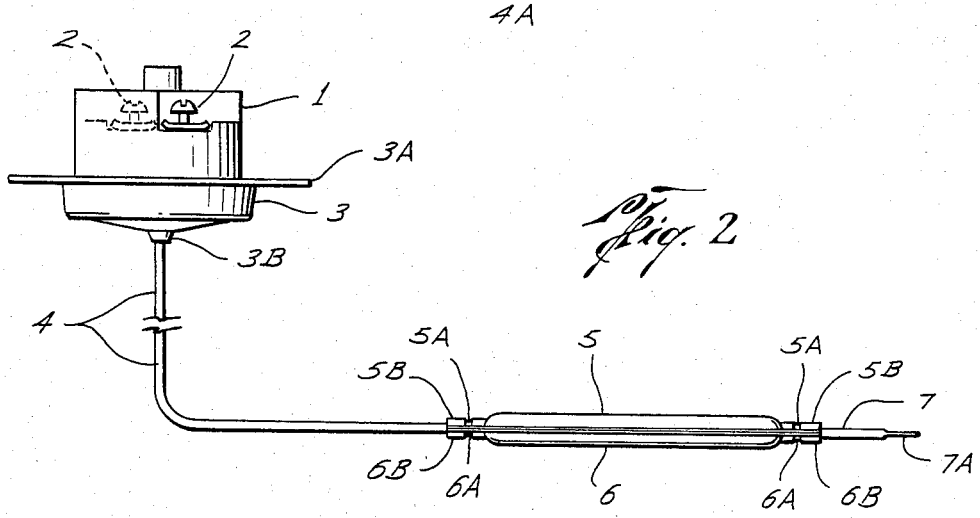
FIG. 2 is a side elevation view of the limit control with capillary tube opening into a sensor bulb with capillary fill end tube and closure for remote protection.
Figure 2A:
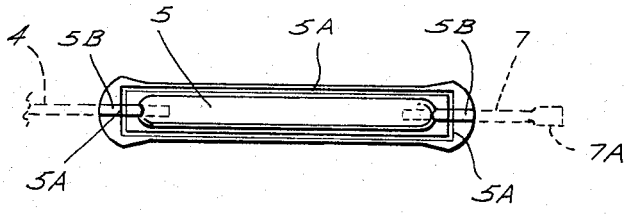
FIG. 2A is a top view of the upper formed stainless steel one-half bulb sensor.
Figure 2B:
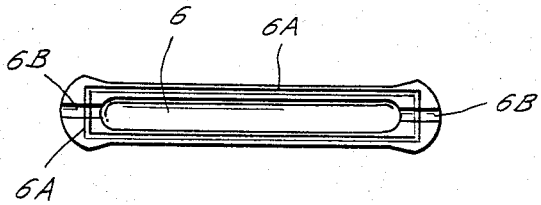
FIG. 2B is a bottom view of the lower stainless steel formed one-half bulb sensor.

FIG. 2 is side elevation view of the limit control with capillary tube 4 opening into a sensor bulb formed from two stainless steel flat metal halves 5 and 6 projection welded together at their respective perimeter inward formed projections 5A and 6A shown in FIG. 2A and FIG. 2B forming a welded, sealed sensor bulb while small formed half-round portions 5B and 6B are welded to the capillary tube 4 and the capillary bulb end fill tube 7 around the continuation of the inward formed projections 5A and 6A.

Figure 3:
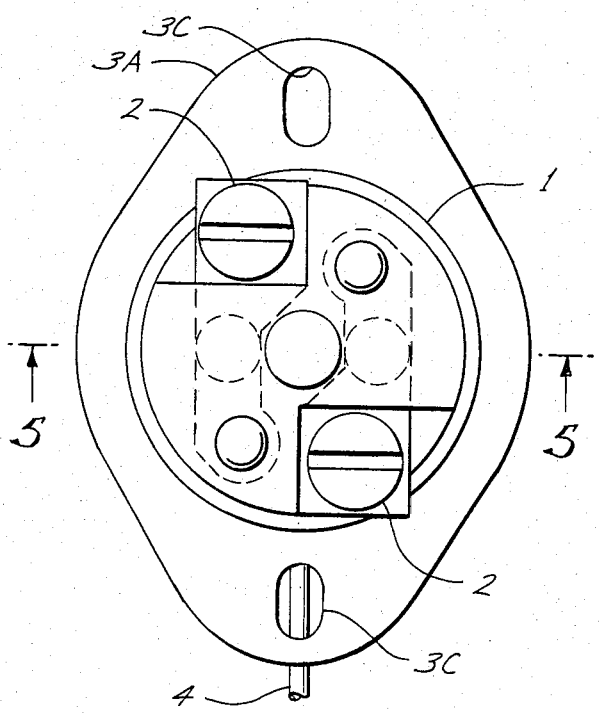
FIG. 3 is a top view showing the thermal switch casing mounted in the top of the formed stainless steel cup.

FIG. 3 is a top view showing the thermal switch 1 press fitted and secured in formed cup 3 provided with flange 3A and mounting holes or slots 3C with electric terminal bolts 2.

Figure 4:
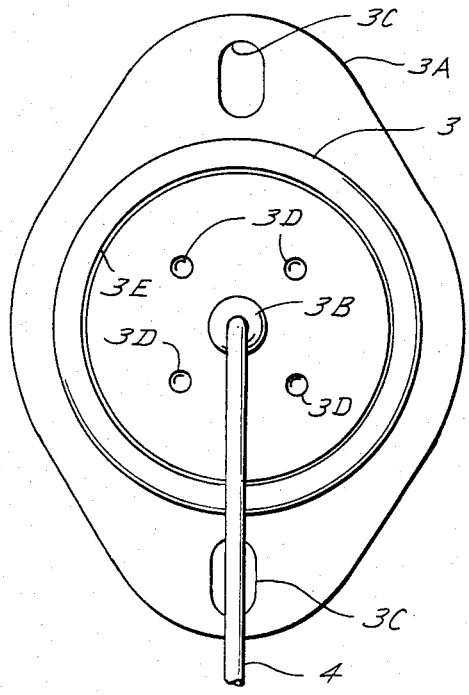
FIG. 4 is a bottom view of the formed stainless steel cup showing the inward formed dimples, outer ring projection, V sloped central outlet with capillary tube.

FIG. 4 is a bottom view of the formed stainless steel cup showing the central V formed outlet 3B and inward formed restricting dimples 3D and inward formed projection 3E to which the diaphragm is circumferentially welded.

Figure 5:
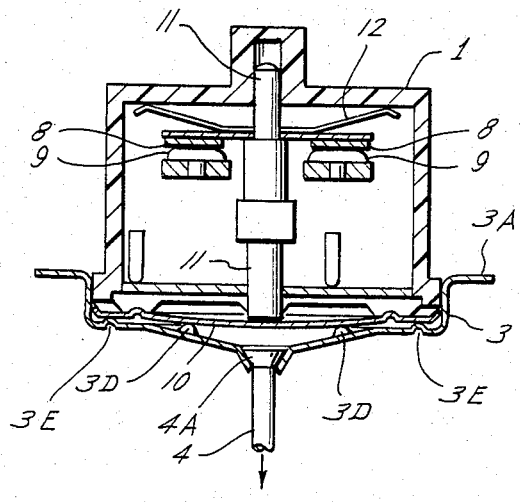
FIG. 5 is a cross sectional view taken across the center of FIG. 3 in the direction of the arrows shown with the switch contacts closed.

FIG. 5 is a cross sectional view taken across the center of FIG. 3 looking in the direction of the arrows shown with the electrical contacts 8 and 9 closed as the formed stainless steel diaphragm 10 is in its pulled down position resting on inward formed restricting dimples 3D allowing plunger rod 11 to extend down assisted by formed flat metal spring member 12. The arrow below capillary 4 indicates the direction of the vacuum pull exerted on the underside of the diaphragm 10.

Figure 6:
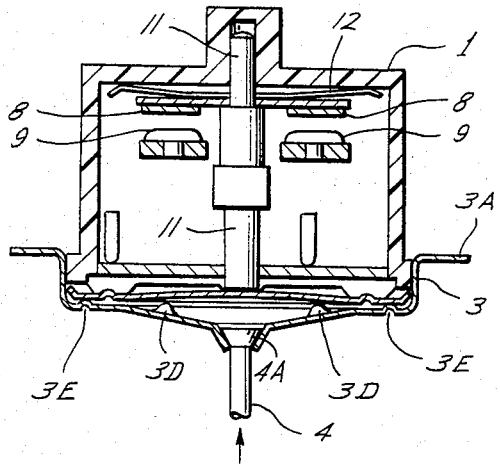
FIG. 6 is a cross sectional view taken across the center of FIG. 3 in the direction of the arrows shown with the switch contacts open.

FIG. 6 is a cross sectional view taken across the center of FIG. 3 in the direction of the arrows shown with the electrical contacts 8 and 9 open as formed stainless steel diaphragm 10 is in its released position as negative pressure or vacuum has been reduced or released as shown by the direction of the arrow below capillary tube 4 this reduction or release of the vacuum is caused by either the boiling of the low vapor thermal fluid within the linear capillary tube 4 as shown in FIG. 1 or the boiling of the low vapor thermal fluid within-pmp remote sensor bulb formed by half-section 5 and 6 of FIG. 2. Also any leakage of the negative pressure or vacuum within the bottom of cup 3 or around the diaphragm 10 or around the central outlet 3B or anywhere within the capillary tube or the sensor bulb will cause a reduction or release of the vacuum within the welded system causing the diaphragm to snap upward and open the contacts for fail safe operation.

In the manufacture of the limit control the stainless steel capillary tube end 4A is flared and circumferentially resistance welded within the formed stainless steel cup outlet 3B. The stainless steel diaphragm 10 is projection welded circumferentially to the inner cup bottom around projection ring 3E formed in cup bottom 3. In a linear control capillary tube 4A is placed on a vacuum line pulling a partial vacuum within the sealed system and through a 3 way valve sufficient low vapor pressure thermal fluid of a specific boiling point is introduced into the capillary tube in a measured quantity to allow sufficient vacuum to remain in order to hold the diaphragm 10 down against restricting dimples 3D and the capillary tube end is then flattened and welded at 4A.

Assembled switch 1 is then press fitted into cup 3 and secured as by forming the vertical side portion inward at several points around the circumference of said vertical wall the linear unit is then ready for test and operation.

The remote sensor bulb control is made in the same manner except the formed bulb halves 5 and 6 are projection welded around their perimeter by means of projections 5A and 6A and also around capillary tube 4 and capillary tube end fill and closure 7. The capillary tube end fill portion is placed on a vacuum line pulling a partial vacuum within the sealed system and through a 3 way valve sufficient low vapor pressure thermal fluid of a specific boiling point is introduced into the thermal bulb and capillary tube in a measured quantity to allow sufficient vacuum to remain to hold the diaphragm 10 against the restricting dimples 3D and the capillary tube end fill 7 is flattened at 7A and welded closed and the switch is then mounted within the cup as previously outlined and the bulb unit is then ready for test and operation.

While I have described the preferred embodiments of my invention and illustrated same in the accompanying drawings, certain minor changes or alterations may appear to one skilled in the art to which this invention relates during the extensive manufacture of same and I therefore reserve the right to make such alterations or changes as shall fall within the scope of the appended claims.

I claim:

1. Fail safe temperature limiting control comprising a formed stainless steel cup, a formed stainless steel diaphragm welded to said cup bottom around its outer peripheral portion, a central cone formed outlet in cup bottom, upward extending dimples formed in cup bottom restricting downward travel of the diaphragm, cone formed capillary tube having an end mating with and welded to the central cone formed cup outlet with an open flexible capillary tube portion extending in coiled or straight manner for linear temperature sensing; as the open capillary tube end is attached to a vacuum pump and low vapor thermal fluid is introduced partially filling the capillary tube and lower sealed cup portion with sufficient vacuum remaining to hold the sealing diaphragm down against the restricting dimples; the open capillary tube end is sealed by welding, a switch means secured to the cup with the switch contacts remaining in their normally closed or operating position, a central actuating rod end resting on the depressed diaphragm; with any leakage of the vacuum within the sealed capillary tube and cup bottom portion the diaphragm snaps upward raising the central actuating rod which raises a contact cross bar off of the stationary contacts within said swtich, opening said contacts; the boiling of the thermal fluid anywhere along the capillary tube likewise reduces the vacuum causing the diaphragm to snap upward opening the swtich contacts; conversely when the fluid cools to a safe temperature the vapors condense restoring the vacuum thus pulling the diaphragm down against the restricting dimples closing the switch contacts as the central actuating rod drops down bringing the contact cross bar against the stationary contacts to provide automatic reset of the control.

2. Fail safe temperature limit control comprising swtich means mounted above and secured to a formed stainless steel cup means with formed stainless steel diaphragm means circumferentially welded to the inner bottom of the cup with a center cone shaped formed outlet in the cup bottom with upward formed dimples in the cup bottom between the formed outlet and a vertical cup side, the outlet is attached to a stainless steel capillary tube with cone shaped end opening welded within the cone shaped outlet in the cup bottom with a flexible capillary tube connected to a remote sensing bulb means formed from two flat stainless steel sections with two half-round depressions forming the outer bulb diameter with two smaller half-round depressions forming a circular opening at each end of the bulb formed by welding two half-sections together around the capillary tube at one end and stainless steel capillary fill end closure tube at the other end accomplished as two half-round formed sections welded as by projection welding with perimeter projections provided in each half-round formed bulb half-section; with the introduction of vacuum suction at the capillary fill tube end withdrawing the air from the bottom of the cup and adjoining capillary tube pulling the diaphragm down against the formed dimples in the cup bottom causing the contacts in the switch means to close as a movable cross bar is lowered to rest on the stationary contacts by a central actuating rod resting on the diaphragm pulled downward by the partial vacuum maintained as low vapor thermal fluid is introduced into the capillary fill tube, which tube is then welded closed, providing a sealed welded system that with the heating of the sensing bulb to a dangerous temperature vacuum breaking vapors are produced causing the diaphragm to snap upward opening the contacts within the switch means, conversely, the cooling of the sensing bulb to a safe temperature causes the vapors to condense restoring the vacuum and pulling the diaphragm down against the formed dimples allowing the switch contacts to close with said dimples acting to limit the downward travel of the diaphragm to prevent its inverted canning or snapping action to become wedged or stationary, further any leakage within the sealed system whether through or around the diaphragm, the cup, the capillary tube, the sensor bulb or the fill closure tube releases the vacuum within the system opening the switch contacts for fail safe operation.

3. Fail safe temperature limit control with linear temperature operating capability comprising a welded stainless steel capillary tube, or remote temperature operating capability with a stainless steel sensing bulb welded to the capillary tube, a stainless steel cup with bottom, switch means secured to the cup, a circumferentially welded stainless steel diaphragm attached to the cup bottom with a plurality of inwardly formed dimples approximately midway between the outer circumference of the diaphragm and a center located cone formed outlet for the capillary tube with said dimples limiting the downward travel of said diaphragm within the cup with capillary tube or capillary tube with stainless steel remote sensing bulb presenting a hermetically welded system that with the introduction of vacuum pressure at the far end of the remote bulb or capillary tube end; the diaphragm is drawn toward the cup bottom and with the introduction of low vapor pressure thermal fluid of only sufficient volume to maintain enough vacuum to hold down the diaphragm, a sealed fail safe vacuum operation results, with reduction or with interruption of the vacuum either by boiling the fluid within the capillary in linear operation or boiling of the fluid in the bulb in remote operation or leakage anywhere within the sealed system the diaphragm snaps upward to its original formed position, opening contacts in the switch means, secured above the cup, as a central actuating rod of the switch means, with a lower end resting on the diaphragm, raises upward raising a switch cross contact member off the stationary contacts of the switch, breaking the electrical current normally flowing through said switch means.

* * * * *